United States Patent [19]

Love

[11] 4,329,902

[45] May 18, 1982

[54] ELECTRONIC METHOD AND APPARATUS FOR MODIFYING MUSICAL SOUND

[75] Inventor: David A. Love, Garden Grove, Calif.

[73] Assignee: Beehler, Mockabee, Arant & Jagger, Los Angeles, Calif.

[21] Appl. No.: 115,057

[22] Filed: Jan. 24, 1980

[51] Int. Cl.[3] ..... G10H 1/04

[52] U.S. Cl. ..... 84/1.25; 179/1 GA; 84/DIG. 1; 84/DIG. 4

[58] Field of Search ..... 84/1.25, 1.01, DIG. 1, 84/DIG. 4; 179/1 E, 1 GP, 1 GQ, 1 GA

[56] References Cited

U.S. PATENT DOCUMENTS

| | | | |
|---|---|---|---|
| 3,004,459 | 10/1961 | Jones | 84/DIG. 4 |
| 3,866,505 | 2/1975 | Adachi | 84/1.25 |
| 3,941,025 | 3/1976 | Kawamoto | 84/1.25 |
| 3,945,290 | 3/1976 | Dittmar | 84/1.25 |
| 4,000,676 | 1/1977 | Love | 84/1.25 |
| 4,162,372 | 7/1979 | Gross | 84/1.25 |
| 4,164,884 | 8/1979 | Kakehashi | 84/1.25 |
| 4,189,971 | 2/1980 | Mantani | 84/1.25 |

*Primary Examiner*—J. V. Truhe
*Assistant Examiner*—Forester W. Isen
*Attorney, Agent, or Firm*—Gene W. Arant; Thomas I. Rozsa; Vernon D. Beehler

[57] ABSTRACT

A continuously varying electrical signal representing an original musical sound is divided at a selected mid-frequency of about 800 Hertz to provide upper and lower frequency signal bands which are then frequency-modulated with separate modulation signals that differ in frequency or amplitude or both, in order to produce a vibrato or tremulant effect and thereby enrich the harmonic content of the musical sound.

In order to inject the vibrato or tremulant into each signal band, the modulation process utilizes a pulse sampling and delay circuit which minimizes clock pulse noise by selecting only the central part of each delayed pulse, and which also senses the original amplitude envelope of the unmodulated wave in order to augment the envelope that is recreated from the delayed pulses after they are recovered.

The resulting modulated signals are recombined, producing a cross-modulation which adds further harmonic components, and the composite signal is again divided at a frequency of about 200 Hertz into high and low frequency output signals which are supplied to respective high and low frequency stationary loudspeakers.

8 Claims, 20 Drawing Figures

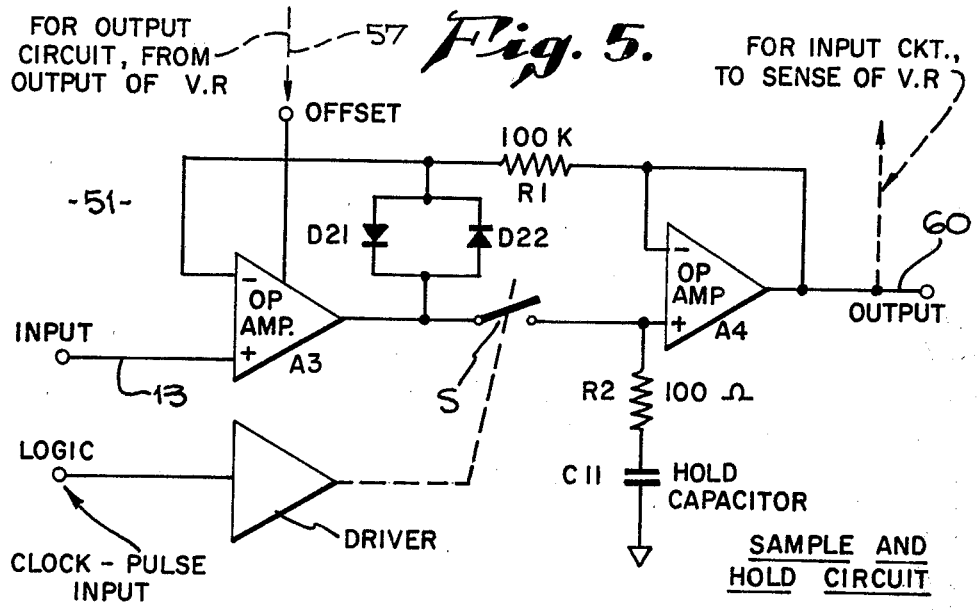
FOR OUTPUT CIRCUIT, FROM OUTPUT OF V.R
57
Fig. 5.
FOR INPUT CKT., TO SENSE OF V.R
OFFSET
100 K
R1
-51-
D21
D22
60
OP AMP. A3
OP AMP A4
OUTPUT
INPUT
13
S
R2
100 Ω
LOGIC
C11
HOLD CAPACITOR
DRIVER
CLOCK - PULSE INPUT
SAMPLE AND HOLD CIRCUIT
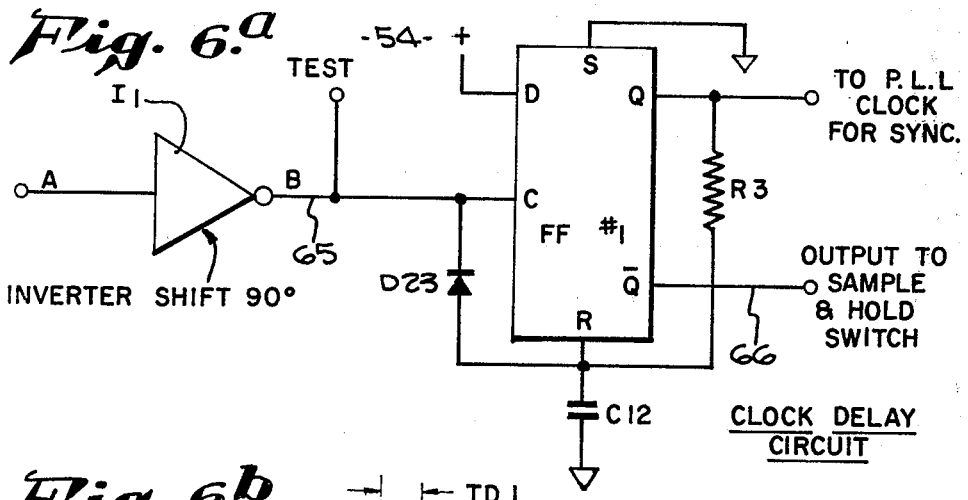
Fig. 6.a
-54-
+
TEST
S
I1
D
Q
TO P.L.L CLOCK FOR SYNC.
A
B
C
R3
FF #1
65
OUTPUT TO SAMPLE & HOLD SWITCH
INVERTER SHIFT 90°
D23
Q̄
R
66
C12
CLOCK DELAY CIRCUIT
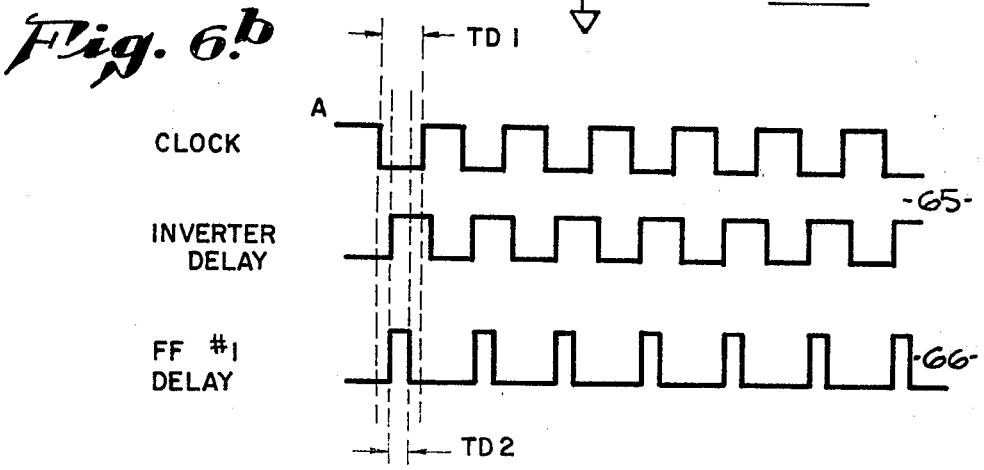
Fig. 6.b
TD1
A
CLOCK
-65-
INVERTER DELAY
FF #1 DELAY
-66-
TD2

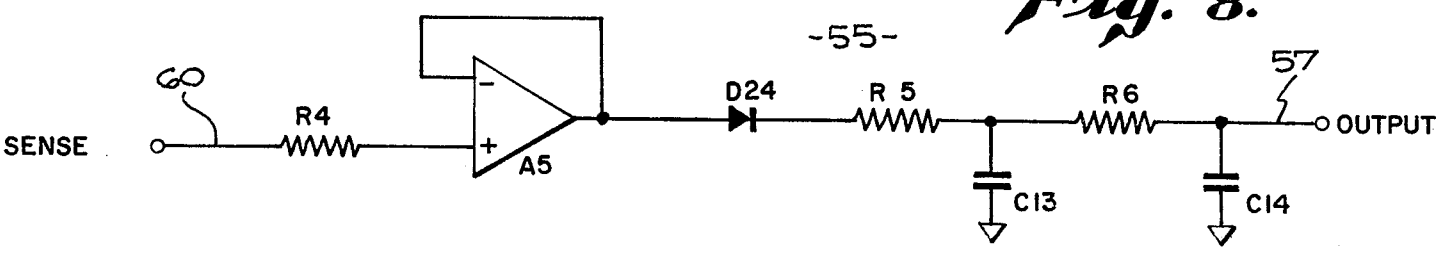
Fig. 8.
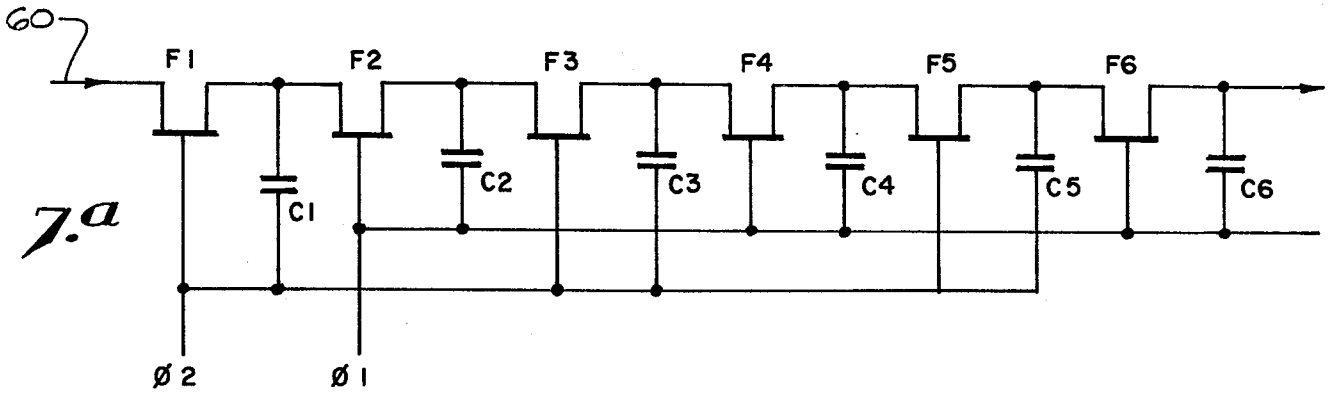
Fig. 7.a
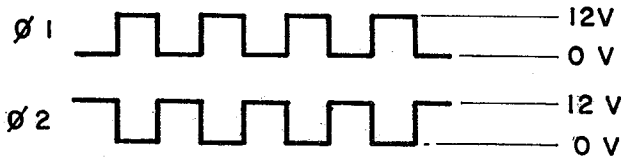
Fig. 7.b

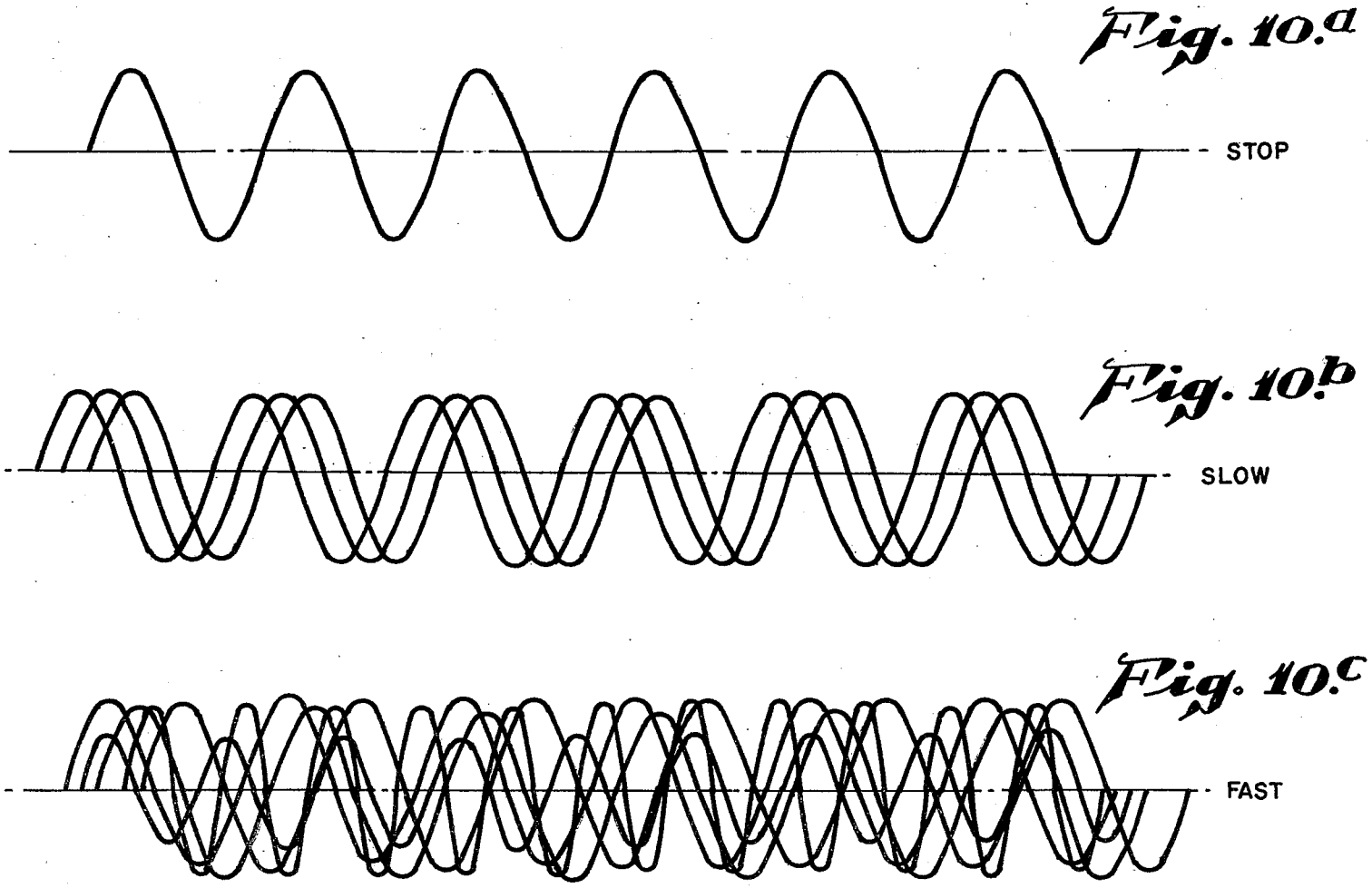
Fig. 10.a
Fig. 10.b
Fig. 10.c

PRE AMP
MDS
CH.2 ( NON-TREM.)
CH.1 ( TREM.)

ELECTRONIC ORGAN
NON-TREMULANT OUTPUT
TREMULANT CIRCUIT
AMP.
FIXED SPEAKERS

ELECTRONIC METHOD AND APPARATUS FOR MODIFYING MUSICAL SOUND

BACKGROUND OF THE INVENTION

1. Field of the Invention

The present invention relates to musical sound, to methods and processes for generating and synthesizing musical sound, and to electronic circuitry and apparatus for carrying out such methods and processes. The present invention combines the artistry of music with the science of electronics to provide significant and useful improvements in this field.

2. Prior Art

Pertinent prior art includes my U.S. Pat. No. 4,000,676 issued Jan. 4, 1977; the nine earlier patents of other inventors that were cited in my previous patent; and U.S. Pat. No. 4,080,861 issued to Wholahan on Mar. 28, 1978.

Other pertinent prior art includes the book "ELECTRONIC MUSICAL INSTRUMENTS" by Norman Crowhurst, published in 1971 by Tab Books, Library of Congress Card No. 70-133801. It also includes the book "THE PHYSICS OF MUSIC" copyright 1978 by Scientific American, Inc., and published by W. H. Freeman and Company, San Francisco.

3. Background

In brief, the utilization of electronic methods for generating or synthesizing musical sound has advanced greatly in recent years. One of the objectives of this field of work is to simulate traditional types of musical instruments such as the pipe organ, as one example. Another objective in this field of work has been to produce strange, startling, or unpleasant sounds. Still another objective has been to create musical sounds which, though different from the sounds produced by traditional instruments, are nevertheless adjudged by competent musicians to be of superior musical quality.

The present invention does not relate to the degradation of musical sound or to the creation of mere attention-grabbing devices. Rather, it relates primarily to the improvement of the artistic level of the musical world by making musical sounds more beautiful. It also relates to more economical and reliable means for producing some of the characteristic sounds for which electronic organs, including their accessories, have become widely known in recent years.

The principal object and purpose of the invention is to provide an improved electronic vibrato or tremulant circuit for electronic organs.

Another object of the invention is to provide improved electronic techniques for generating, synthesizing, or modifying musical sound.

SUMMARY OF THE INVENTION

One feature of the present invention is an improved electronic method and circuit for frequency-modulating a continuously varying electrical signal that represents an initial version of a musical sound, with a modulation frequency that is below about 15 Hertz, so as to provide a modulated output signal which can then be converted through a loudspeaker into a harmonically enriched version of the musical sound.

Another feature of the invention is a method of enriching musical sound by separating a continuously varying electrical signal representing an initial version of the sound into upper and lower frequency bands, modulating the two frequency bands separately but in different ways so as to enrich their harmonic content, and then combining the modulated frequency bands to produce a composite modulated signal.

According to still another feature of the present invention an electrical signal representing musical sound is divided into a pair of frequency bands for purpose of harmonically enriching them, the frequency bands are recombined into a composite enriched signal, and then the composite enriched signal is again separated into two frequency bands, but at a different mid-frequency point, for more effective application to respective high frequency and low frequency loudspeakers.

Yet another feature of the invention is a method of enriching the harmonic structure of a wave form representing musical sound by dividing the original wave form into frequency bands, modulating the frequency bands with signals of different characteristics, and then recombining the modulated signals so as to produce a further cross-modulation between the initial modulation products.

Still another feature of the invention is the provision of an improved frequency-modulation circuit employing pulse sampling techniques, which may be applied in other fields as well as in electronic musical instruments.

Another further feature of the invention is a technique or method for eliminating or significantly reducing clock-pulse noise in pulse-sampling circuits.

Yet another feature of the invention is a novel electronic circuit for producing the vibrato or tremulant sound of electronic organs, without mechanical moving parts.

Still a different feature of the invention is the provision of a novel and attractive stereo loudspeaker.

THE MUSICAL PROBLEM

Many characteristics of musical sound are subject to rather precise scientific measurement. A continuous acoustical vibration can be converted into a continuous electrical wave whose variations correspond precisely to those in the acoustical wave. The electrical wave can then be analyzed mathematically to identify all of its various frequency components—that is, although not itself a pure sine wave oscillation it can be determined to be the equivalent of the summation of a number of different pure sine waves that are of different frequencies. Rather than analyzing it mathematically the electrical wave may instead be applied to a series of filters which will actually separate the original wave into a number of different waves that may not be pure sine waves but whose frequencies fall within particular frequency bands. In addition to assessing the frequency components of an acoustical wave it is also possible to measure rather precisely its energy content, including both its total energy content and the amounts of energy that it contains at various specific frequencies or within specified frequency bands. There are also many other characteristics of musical sound, too numerous to mention here, which are subject to precise scientific measurement.

Evaluating the sensations which human beings derive from musical sound is, however, an entirely different matter. Perhaps everyone will agree that a loud BANG on a drum is an attention-getting device and is startling. There is also a considerable amount of agreement as to whether a particular group of tones played concurrently are harmonious, or are inharmonious. But there is much less agreement as to when harmony is to be preferred over inharmony, or vice versa.

The analysis of tone structures produced by traditional musical instruments is a useful guide as to what should best be done when musical tones are being synthesized, processed, or modified by electronic means. But it is not the only criteria. No doubt a better criteria is what a selected group of individuals, who have succeeded in establishing themselves in the minds of the public as musical experts, may ultimately agree constitutes good or beautiful music.

The present invention in the present drawings is illustrated as being applied to one specific type of musical instrument, namely, an electronic organ. An important aspect of the invention, therefore, is the degree of success with which it simulates the sounds of the traditional pipe organ, or the hitherto accepted sounds of the electronic organ that has now largely replaced the pipe organ, or both. But in addition to simulating what has been done before, the present invention also produces an "improved" tone quality or sound characteristic for electronic organs. This is accomplished by combining the frequencies and magnitudes of electronic signals within the circuitry in ways that have not been done previously.

It should by no means be supposed, however, that the present invention is limited to electronic organs. On the contrary, the methods and circuitry provided by the present invention can be applied in many other types of musical instruments and musical systems, regardless of the name or description that may be given to them.

DRAWING SUMMARY

FIG. 5 is a schematic diagram of the input "sample and hold" circuit included within the circuit of FIG. 4;

Figure 4:
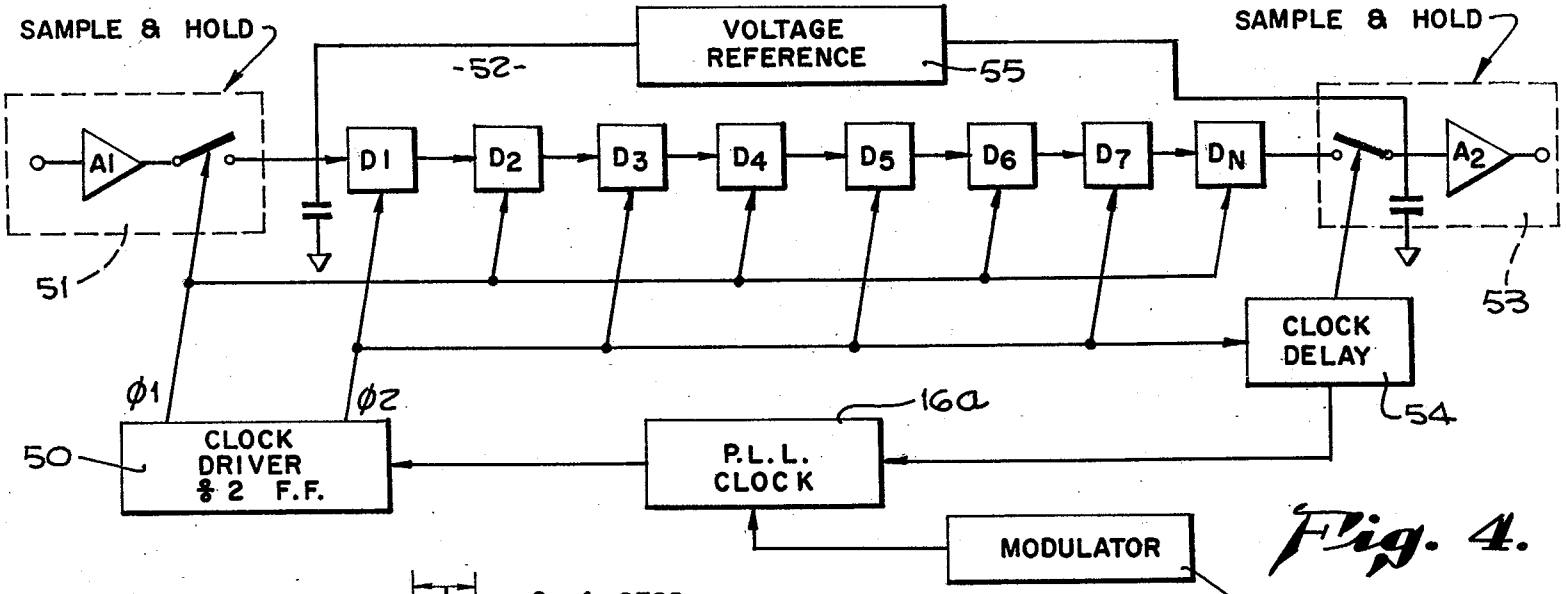
FIG. 4 is a schematic block diagram of one of the individual frequency modulation circuits shown in FIG. 2.

FIG. 6*a* is a schematic diagram of the clock delay circuit of FIG. 4;

FIG. 6*b* shows wave forms produced by the clock delay of circuit 6*a;*

FIG. 7*a* is a circuit diagram of the shift register of FIG. 4;

FIG. 7*b* shows the clock pulse wave forms applied to the shift register of FIG. 7*a;*

Figure 9A:
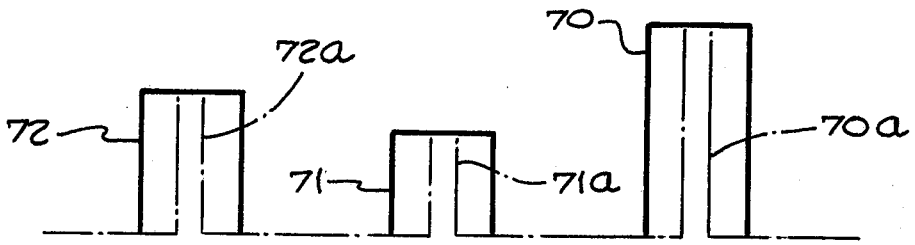
Figure 9B:
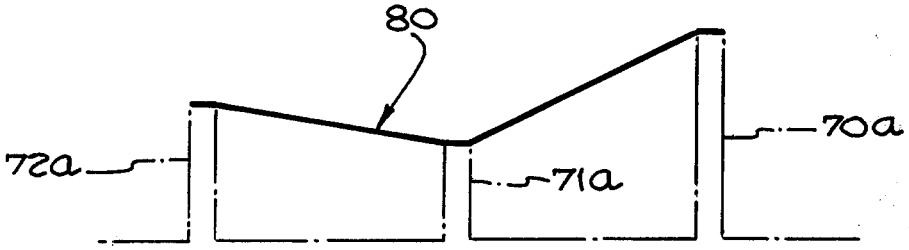

FIG. 8 is a circuit diagram of the voltage reference circuit of FIG. 4;

FIG. 9*a* is a wave form diagram showing how the delayed pulses appearing at the output of the shift register of FIG. 4 are sampled by the final sample and hold circuit;

FIG. 9*b* is a wave form diagram showing the smoothing action that is applied to the samples of FIG. 9*a;*

Figure 2:
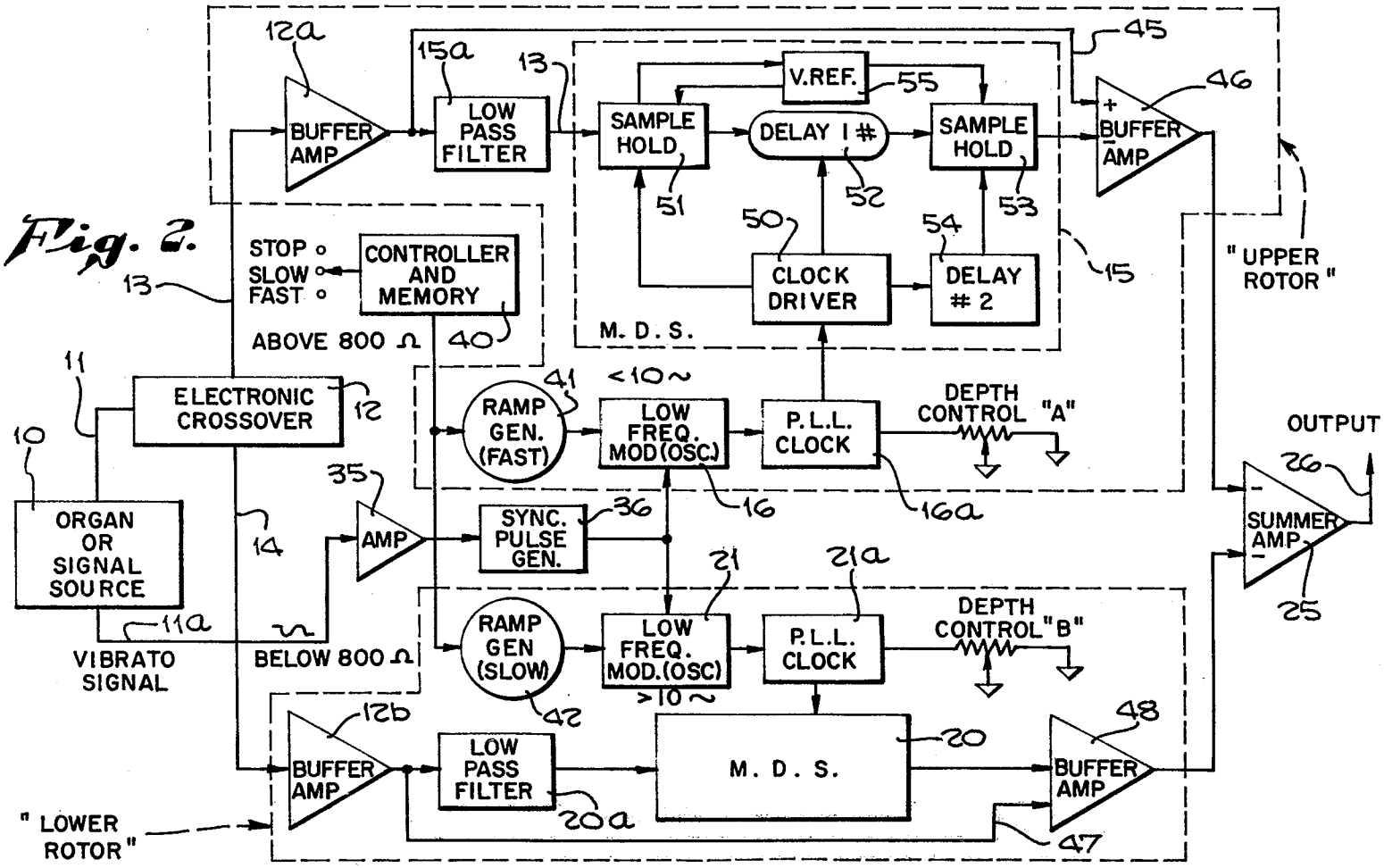
FIG. 2 is a more detailed schematic block diagram of the "Upper Rotor" and "Lower Rotor" modulation circuits of FIG. 1.
Figure 9C:
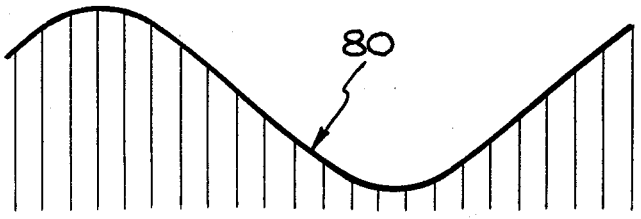
Figures 11, 12, 13, 14:
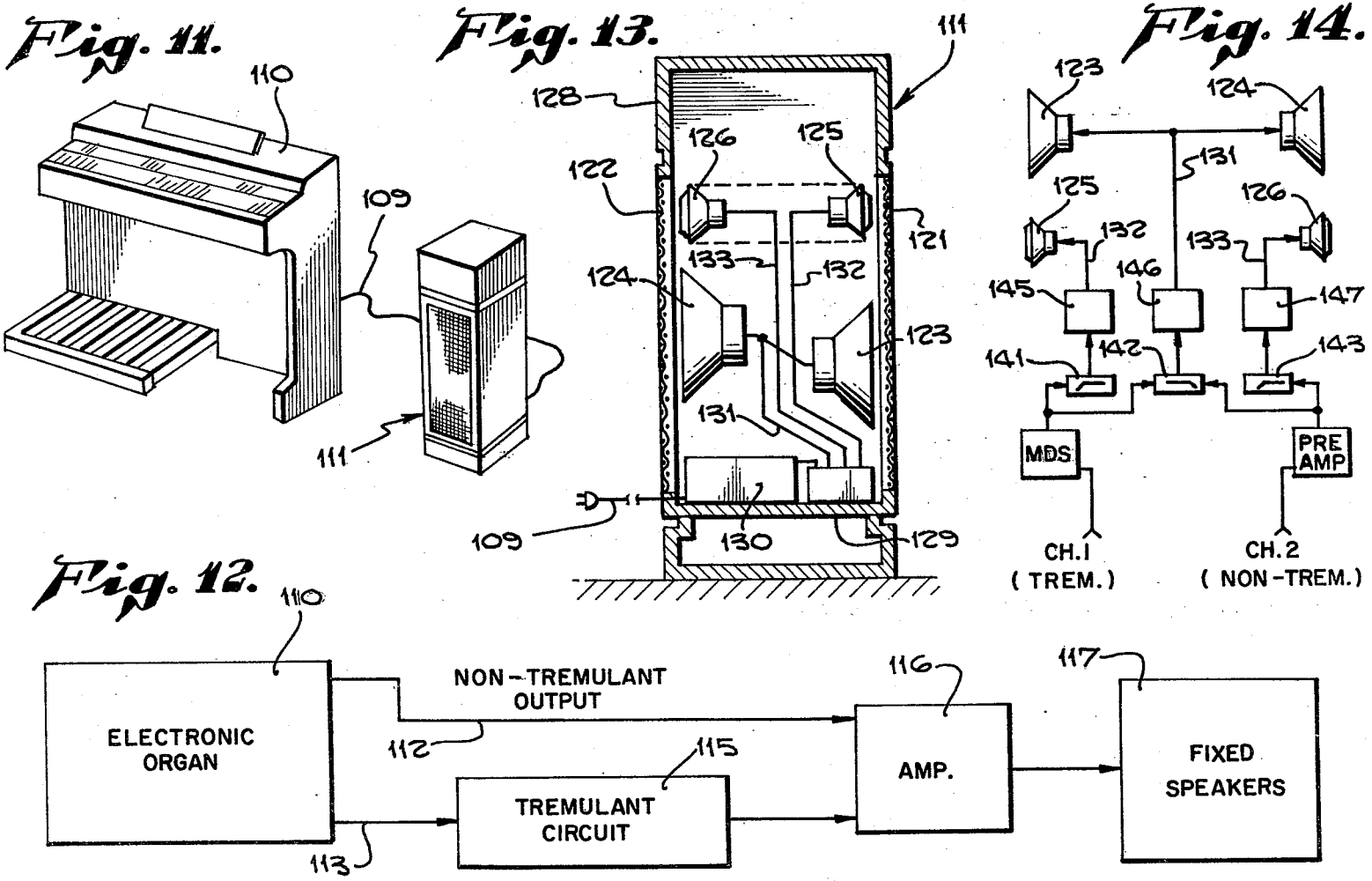

FIG. 9*c* shows the wave form envelope that is recovered at the output of the circuit of FIG. 4;

FIG. 10*a* illustrates the transmission of a 2,000 Hertz wave form through the "Upper Rotor" circuit of FIG. 2 when the modulator oscillator is turned off;

FIG. 10*b* illustrates the same wave form when the modulator oscillator is operating at a frequency of about one Hertz;

FIG. 10*c* illustrates the same wave form when the modulator oscillator is operating at about six Hertz;

FIG. 11 is a perspective view of an electronic organ with external tower speaker system;

FIG. 12 is a schematic block diagram of the organ system of FIG. 11;

FIG. 13 is a side elevation view of the speaker tower showing its internal components; and FIG. 14 is a circuit diagram showing the amplifier and speaker connections in the speaker tower.

PREFERRED EMBODIMENT

Figure 1:
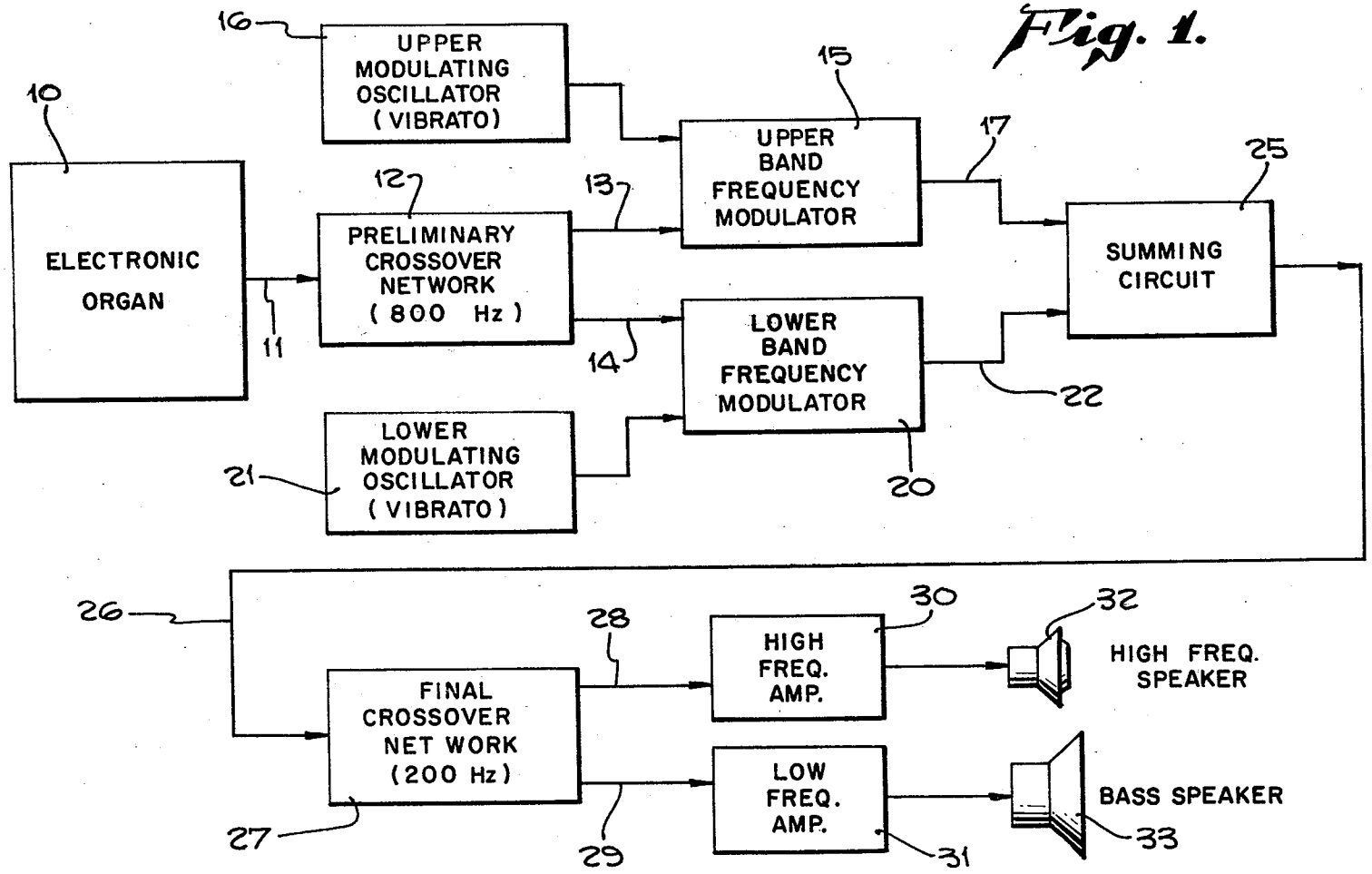
FIG. 1 is a schematic block diagram of an electronic organ system incorporating the invention.
Figure 3:
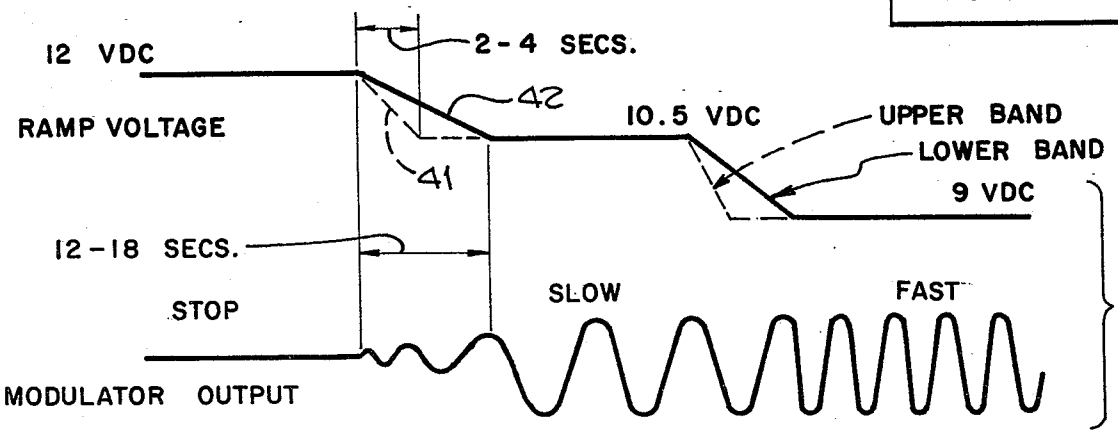
FIG. 3 illustrates wave forms of the frequency modulators of FIG. 2 and of the ramp generators which control them.

The drawings of the present application, FIGS. 1 through 14, inclusive, illustrate a single presently preferred embodiment of the invention. FIG. 1 is a schematic diagram of a complete electronic organ system in accordance with the invention, in which originally generated tones are divided into upper and lower frequency bands, the two bands are separately frequency-modulated with low frequency or vibrato signals, the thus modulated signal bands are combined to form a composite modulated signal, and the composite signal is then separated into high and low frequency output signals which are fed to high and low frequency loudspeakers, respectively. FIG. 2 is a schematic diagram of the circuitry that divides the original tones into upper and lower frequency bands and then modulates those bands with separate vibrato signals. FIG. 3 shows wave forms representing the vibrato signals, as well as wave forms that control the frequency selection and the turn on characteristics of the vibrato signals.

FIGS. 4 through 10, inclusive, contain schematic block diagrams, as well as detailed circuit diagrams, of the circuitry for an individual one of the frequency-modulation circuits. They also illustrate wave forms associated with the operation of an individual one of the frequency-modulation circuits.

FIGS. 11 through 14, inclusive, show an external fixed speaker system for an electronic organ, which speaker system incorporates an entirely electronic vibrato or tremulant circuit.

ELECTRONIC ORGAN SYSTEM

An electronic organ system in accordance with the present invention is shown in FIGS. 1 to 3, inclusive. As shown in FIG. 1 an electronic organ 10 is capable of generating conventional electronic organ tones. That is, it can generate a chord consisting of several separate notes or tones that are harmonically related, and each of which also has its own overtone or harmonic structure. Thus, one of the notes or tones may have a fundamental frequency of F1 together with harmonics 2F1, 3F1, 4F1, etc. A second note or tone in the chord may have a fundamental frequency of F2 together with harmonics 2F2 to 9F2, inclusive. And a third note or tone of the chord may have a fundamental frequency F3 together with harmonics that are various multiples of the frequency F3. But it is assumed that the notes in this originally generated chord are relatively stable tones—that is, the vibrations continue at relatively constant amplitude and relatively constant frequency.

The original electrical signal 11 is supplied to a preliminary crossover network 12 having a mid-frequency of about 800 Hertz, which then produces an upper signal band 13 containing frequencies above about 800

Hertz and a lower signal band 14 containing frequencies below about 800 Hertz. These signal bands will then be separately processed and modulated in order to modify and improve their musical character.

Thus the upper signal band 13 is applied to an upper band frequency modulator 15. The output signal of an upper modulating oscillator 16 is also supplied to the frequency modulator 15 as an additional input. The output signal of modulating oscillator 16 is typically a sine wave signal having a frequency less than 15 Hertz. Frequency modulator 15, therefore, develops a modulated output signal 17 containing a frequency-modulated version of the upper signal band.

In similar fashion the lower signal band 14 is applied to a lower band frequency modulator 20. A lower modulating oscillator 21 generates a modulating signal, typically a sine wave having a frequency of less than 15 Hertz, which is supplied as an additional input to the modulator 20. The output signal 22 of modulator 20 is a frequency-modulated version of the lower signal band.

The modulated signal bands 17 and 22 are then applied to a summing circuit 25 where they are added together to form a composite modulated signal 26. This composite signal is applied to a final crossover network 27 having a mid-frequency of about 200 Hertz, and which produces separate high and low frequency output signals 28, 29, respectively. The high frequency output signal 28 is fed through high frequency amplifier 30 to high frequency loudspeaker 32, while the low frequency output signal 29 is fed through low frequency amplifier 31 to the bass speaker 33.

BAND SEPARATION FOR DIFFERENTIAL MODULATION

There is only one purpose for separating the original signal 11 into upper signal band 13 and lower signal band 14 as shown in FIG. 1. This is to make it possible to modulate each of the signal bands in a different manner or fashion from the other.

This is a musical reason, not a technical reason. That is, in terms of electronic circuitry, any of the modulation actions that are to be performed on one of the frequency bands could be performed at the very same time on the other frequency band, and it would probably be more economical to do so with a single circuit rather than with two separate circuits. But for musical purposes the modulation characteristics that are desired for high frequencies are different from those that are desired for low frequencies. Hence the separation of the signal into two frequency bands.

One aspect of the modulation is the frequency of the modulating signal. Another is the amplitude of the modulating signal. Still another is the rapidity with which the modulation is initiated or stopped; that is, the slope of the attack or decay curve. In general, the upper and lower signal bands are modulated differently with respect to at least one of these characteristics. More specifically, in accordance with the system of FIG. 1 they are modulated differently as to all of these characteristics.

While separation into two frequency bands is presently illustrated, it is also within the scope and intent of the invention to separate the original signal into three or more frequency bands, for purpose of imparting different modulation characteristics to those bands, if that should be desired.

Reference is now made to FIG. 2 illustrating the frequency modulation system in more detail. Some portions of this circuit will be described presently while others will be described in later paragraphs.

The organ 10 and crossover 12 are as shown in FIG. 1. Upper signal band 13 is supplied to a buffer amplifier **12*a* which adds power and stability to the circuit but does not change the musical tone. It then enters a low pass filter 15*a* which transmits it on to the frequency modulator circuit 15. The purpose of low pass filter 15*a* is to filter out the frequencies above about 20,000 Hertz, which have little or no musical value but which could interfere with the operation of the modulator 15** if they were permitted to enter into it.

In similar fashion the lower signal band 14 enters a buffer amplifier **12*b* which stabilizes it without altering the musical note. It then enters the low pass filter 20*a* before reaching modulating circuit 20. Filter 20*a*** rejects frequencies above about 800 Hertz.

It will be noted that modulator circuit 15 is shown in the form of a dotted box within which a number of solid boxes and circuit connections are arranged to schematically illustrate the circuit construction. The structure and operation of this circuit are described in detail in later chapters of this description. Modulator 20 is indicated by a single solid box, but it is constructed and operates in exactly the same fashion as modulator 15.

DIFFERENTIAL VIBRATO ATTACK

FIG. 2 shows an output line **11*a* from the organ 11 which may supply a vibrato signal through an amplifier 45 to synchronizing pulse generator 36. The output of pulse generator 36 in turn is supplied to both the modulating oscillator 16 and the modulating oscillator 21 for controlling and synchronizing their operation. This circuit feature, however, relates to a mode of operation that is used only occasionally. In the present discussion it is assumed that there is no vibrato signal 11*a* and that pulse generator 36 is not operating, leaving oscillators 16 and 21** to find their own operating frequencies independent of each other.

A controller and memory 40 is used for the purpose of starting and stopping the vibrato oscillators as well as for controlling their frequency. The output of controller 40 goes to a fast ramp generator 41 which in turn controls the operation of oscillator 16, and also to a slow ramp generator 42 which controls the operation of oscillator 21. Controller 40 has STOP, SLOW, and FAST positions. The operation is illustrated by the wave forms of FIG. 3.

Thus as shown in FIG. 3, in the STOP condition of the controller each of the ramp generators produces its maximum output voltage, which blocks the corresponding modulator from producing any output oscillations at all. When the ramp voltage is dropped from its maximum of twelve volts to its intermediate level of 10.5 volts, then the associated oscillator will oscillate at a frequency of about 1.0 Hertz. When the ramp voltage is dropped to its lower limit of 9 volts the associated oscillator oscillates at about 6 Hertz. FIG. 3 also shows the different treatment of attack and decay for the upper and lower signal bands. The solid line 42 for ramp voltage indicates a relatively slow attack and decay for the lower signal band, in which about 12 to 18 seconds is required for changing the oscillating frequency of the modulator. Dotted line 41 shows a more rapid attack or decay for the upper signal band, with the change in modulator frequency being accomplished in about two to four seconds.

DIFFERENTIAL VIBRATO AMPLITUDE EFFECT

As shown in FIG. 2 the output of modulator 16 is applied to a clock generator 16*a*. The clock generator is of the P.L.L. or phase-locked loop type. Associated with clock generator 16*a* is a variable resistor identified as DEPTH CONTROL "A". The adjustment or setting of this resistor determines the base or center frequency of the clock generator; and because the actual length of the shift register is fixed, a change in the oscillator frequency changes the effective length of the register. The resistor setting thereby controls the effective depth of modulation.

The output of low frequency modulation oscillator 21 is applied to a clock pulse generator 21*a*. Generator 21*a* is also of the P.L.L. or phase locked loop type. Associated with generator 21*a* is a variable resistor identified as DEPTH CONTROL "B". The adjustment or setting of this resistor likewise controls the center frequency of the clock pulse produced by the generator 21*a* and hence the strength of the vibrato that is injected into the lower signal band. The higher the clock pulse frequency is set, the less the frequency swing that is caused by the modulating signal from oscillator 20.

In general, the depth controls for the upper and lower signal bands are set differently from each other. For musical reasons it is generally preferred to set the vibrato for the lower signal band at a much stronger frequency swing or amplitude than the vibrato for the upper signal band. However, in terms of the frequency or phase shifts that are induced in the musical tones, the shifts are much smaller in the lower signal band because the frequencies of the musical tones themselves are much smaller in the first instance.

In the prior art one of the primary problems was the depth of modulation. When it was apparently correct for the midrange frequencies, i.e., 440 Hertz to 1 KiloHertz, the frequencies above 3 KiloHertz were modulated to a point of being out of pitch and the frequencies below 300 Hertz were very weak in their effective depth of modulation. Leslie had solved this problem by dividing the frequency spectrum at 800 Hertz with the upper and lower frequencies directed to two different rotors. This created two separate and independent doppler shifts, and the acoustic combination of the two created yet another doppler effect. Prior to the present invention the same result had not been achieved electronically using fixed speakers.

As is known in the art, the effective vibrato amplitude may if desired be controlled or adjusted by a voltage divider technique.

DIFFERENTIAL VIBRATO FREQUENCY; CROSS-MODULATION

In general, the modulating oscillators 16 and 21 are not synchronized with each other. Even when both are operating at a nominal frequency of about 6 Hertz the actual frequencies are nevertheless different.

Therefore, when the output signals of the upper and lower signal bands are added or summed together there is a cross-modulation signal that is produced as a beat frequency representing the difference between the frequencies of the two modulation oscillators. I have heard this beat frequency in the sound output of the loudspeakers and it has also been independently verified by other musicians. It adds a warmth to the final musical sound which would otherwise be lacking.

It also appears that there may very well be cross-modulation that is produced by the different vibrato amplitudes in the upper and lower signal bands, and this may also to some extent account for the observed enrichment or warmth in the final musical sound.

FREQUENCY MODULATION CIRCUIT

Reference is made to the frequency modulation circuit 15 shown in FIG. 2, also known as the MICRO-DIGITAL SYNTHESIZER or M.D.S. circuit. Details of this circuit are shown in FIGS. 4, 5, 6*a*, 7*a*, and 8, and wave shapes illustrating its operation are shown in FIGS. 6*b*, 7*b* and 9.

In general, in the M.D.S. circuit an original signal which is of a continuously varying or analog nature is repeatedly sampled at very short intervals of time to produce a series of spaced pulses whose individual amplitudes correspond to the amplitude of the sampled portion of the original signal. The series of pulses are delayed in passing through a shift register, and the spacing between them is altered at the same time to produce a frequency-modulation effect. Then at the output end of the shift register the digital pulses are converted back to an analog signal which therefore represents a frequency-modulated version of the original signal. This general technique is already well-known in the art. For example, it is illustrated and described in some detail in the Kawamoto U.S. Pat. No. 3,895,553 and particularly in FIGS. 1 through 4, inclusive, of that patent.

The M.D.S. circuit in accordance with the present invention incorporates two separate and distinct improvements over the prior art. One is a method and circuit for eliminating or reducing clock pulse noise, which is accomplished by a novel side-stepping technique. The other specific improvement is the sensing of the original signal in a smoothed or integrated form, which is fed in parallel with the delay line or shift register and is then utilized at its output in conjunction with a sample-and-hold circuit for recreating the music signal.

Before describing the specific improvements in detail, however, the general arrangement and operation of the circuit will first be described.

Thus as shown in FIG. 2, and in more detail in FIG. 4, the present M.D.S circuit includes a clock driver 50, an input sample and hold circuit 51, a delay line 52, an output sample and hold circuit 53, a clock pulse delay 54, and a voltage reference circuit 55. Clock pulse generator 16*a* and its depth control A are located outside the integrated circuit. A circuit loop for stabilizing the oscillator passes from generator 16*a*, through driver 50 and clock delay 54 back to the generator.

As seen in FIG. 4 delay line 52 is in the form of a shift register including a series of stages or delay units D1, D2 . . . DN, the specific circuitry being shown in FIG. 7*a* where it is seen to include a series of field effect transistors F1, F2, F3, etc. having respectively associated capacitors C1, C2, C3, etc. As shown in FIGS. 7*a* and 7*b* alternate stages of the register are driven by complementary outputs of the clock driver.

The input sample and hold circuit 51 shown in FIG. 5 is of conventional construction. Upper band input signal 13 is fed to the non-inverting input of operational amplifier A3. The output of this amplifier passes through a switch S, which is a solid state relay, and hence to the non-inverting input of operational amplifier A4, which is also grounded through resistor R2 and hold capacitor C11 to the circuit ground. It should be noted that FIG. 4 shows only a simplified schematic of the sample and hold circuit 51, with the true circuitry being shown in FIG. 5. The output terminal 60 of the sample and hold circuit is connected to the input lead of F1 in the shift register (FIG. 7*a*) and is also connected to the "sense" input of the voltage reference circuit 55 (FIG. 8).

Also in circuit 51 the inverting inputs of amplifiers A3 and A4 are interconnected through resistor R1 whose typical value is 100 K Ohms. The output of amplifier A3 is tied directly back to its input through a parallel pair of diodes D21, D22 connected in opposing polarities. And the output of amplifier A4 is connected back to its inverting input. As is known for this type of circuit, the hold capacitor C11 has a relatively large capacitance value, making it possible to store a substantial charge when switch S is opened under control of the clock pulse, thereby storing the potential level sampled when it was interrupted.

As is well-known, the analog input signal is sampled during alternate half cycles of the clock pulse voltage, and application of the clock pulse voltage to the shift register causes the selected pulse amplitudes to be progressively shifted along the register.

The sampling pulses developed by the clock generator 16*a* have a repetition rate of at least 1,000,000 per second and preferably about 1,500,000. In the lower rotor, however, clock generator 21*a* operates at a rate of about 500,000 per second. A minimum rate of about 200,000 is necessary for good fidelity. The two clocks are deliberately non-synchronized.

ELIMINATING CLOCK PULSE NOISE

Reference is made to FIG. 6*a* illustrating the clock delay circuit 54, and to FIG. 6*b* showing wave forms associated with its operation. The clock signal from driver 50 is supplied to inverter I1 which provides an inherent time delay or shift of 90 degrees so that its output wave 65 is delayed to that extent relative to the clock pulse, as shown in FIG. 6*b*. The square pulse 65 is supplied to the input of flipflop FF1 whose complementary or $\overline{Q}$ output provides an output pulse 66. As shown in FIG. 6*b* each individual output pulse 66 has a duration TD2 which is only about half the duration TD1 of the original clock pulse applied to inverter I1. This output results from the fact that flipflop FF1 is a monostable circuit and its time period is about half or less the time period of one-half of the original clock pulse.

Output sample and hold circuit 53 is constructed identically to the input sample and hold circuit 51. Output 66 of the clock delay circuit 54 is connected to the clock pulse input of sample and hold circuit 53.

The purpose of clock delay circuit 54 is to eliminate or minimize clock pulse noise that would otherwise be induced in the output circuit. Shift register 52 has many stages. This clock pulse signal, in one polarity or the other is applied to each of these stages. Thus, each time the clock pulse signal switches its polarity there are a multitude of circuit elements within and associated with the shift register that combine their forces to tend to induce undesired transients in the signal output circuit. The present invention solves this problem by means of a "sidestepping" technique. That is, the output signal from the shift register is supplied to the output sample and hold circuit 53, but that is not what is used as the final output signal. The final output signal is derived by means of a gating technique under control of the clock delay circuit 54. It does not sample the signal supplied to the sample and hold circuit 53 when the clock pulse generator is switching its output state; rather, it "sidesteps" those times when the undesired transients are being induced. It instead gates the sample and hold circuit 53 for a time interval which is much shorter than half a clock pulse, commencing after a half clock pulse has started, and concluding before that half clock pulse has terminated, and thereby excluding both the leading edge and the trailing edge of the delayed pulse presented to the output sample and hold circuit 53.

It should be noted in accordance with the invention that clock pulse noise will be reduced if the output signal is sampled in such a way as to reject either the leading edge or its trailing edge. But the preferred technique in accordance with the present invention is to select only the central part of each delayed pulse, rejecting both its leading edge and its trailing edge, and thereby avoiding the transient voltages that are induced during both switching directions of the clock pulse generator.

This operation is illustrated in FIGS. 9*a* and 9*b*. A series of pulses 70, 71, and 72 represent samples which were taken from the input signal 13 and which have been progressively advanced down the shift register 52 so that they will in sequence reach the output sample circuit 53. FIG. 9*a* shows in dotted lines a central portion 70*a* of the pulse 70, a central portion 71*a* of the pulse 71, and a central portion 72*a* of the pulse 72. The sampling or gating at the output is produced by the combined action of clock delay circuit 54 and output sample and hold circuit 53. Pulses 70*a*, 71*a*, 72*a* are therefore permitted to pass through the output sample and hold circuit 53 where the smoothing action of the hold capacitor C11 tends to create an amplitude envelope 80. This is shown in FIG. 9*b*. The amplitude envelope 80 for a considerable series of the delayed pulses is shown in FIG. 9*c*.

RECREATING THE MUSIC SIGNAL

There tends to be some loss of signal amplitude or strength as the pulse samples are advanced along the shift register 52. In accordance with the present invention this tendency is counteracted by means of voltage reference circuit 55. The voltage reference circuit 55 may alternately be referred to as an envelope follower circuit, or as a partial bypass circuit.

The sense input of voltage reference circuit 55 does not receive the continuously varying or analog input signal 13. Rather, it receives the pulse samples at the output of the first sample and hold circuit 51. The signal passes through resistor R4 having a typical value 100 K Ohms and hence through a follower circuit A5. Next in the series circuit is a diode D 24 which ensures that only a D.C. voltage is transmitted. The signal is then fed through a resistor R5 whose output is coupled to circuit ground by a capacitor C13, these elements together forming a first integrator. There then follows a second integrator including resistor R6 and capacitor C14. Resistors R5 and R6 may typically have a value of 100 K Ohms while each of the capacitors C13, C14 may have the value of 0.001 micro-farad. The output signal appearing at terminal 57 of the voltage reference circuit is applied to the offset input terminal of operational amplifier A3 in the output sample and hold circuit 53. See FIG. 5.

Due to the two integrators in series, the voltage reference circuit 55 acquires a smoothed and weakened version of the pulse series applied to the input of delay line 52. The application of this signal to the offset input of amplifier A3 in circuit 53 aids and reinforces the pulse train that is being directly received from the output end of delay line 52. The total time delay in the delay line or shift register 52 is in the range of about 20 to 40 milliseconds. The total delay in voltage reference circuit 55 is a great deal shorter, and negligible by comparison. Thus, the amplitude envelope of the music signal as it is recreated in the output circuit 53 is mainly determined by the amplitudes of delayed pulses that have been transmitted through the shift register, which are sometimes accelerated and sometimes delayed relative to each other by action of the modulation oscillator 16, but to some extent the amplitude envelope 80 is also determined by a weakened and relatively undelayed version of the pulse samples that were supplied to the input end of the shift register.

More specifically, as pointed out earlier, the clock delay circuit 54 serves to gate or sample only the central portion of each delayed pulse arriving at the output end of the shift register. Thus, it is these pulses in cooperation with the envelope follower signal transmitted through circuit 55 which create the amplitude envelope 80 as shown in FIG. 9*c*.

While the technique for eliminating clock-pulse noise is disclosed here in conjunction with the frequency modulation of a musical signal, it is useful whenever the spaces between pulses are being altered, whether or not such alteration conforms precisely to a frequency modulation theory. It may also be applied in reverberation or other circuits where the music signal is being delayed but not otherwise modified. The technique may also be employed in communication circuitry for processing sounds which are not purely musical in nature.

THE "CHIRP" SIGNAL (FIGS. 2 AND 10)

As shown in FIG. 2 the upper band input signal 13, in addition to being supplied to the frequency modulation circuit 15, is also applied directly along a signal line 45 to the non-inverting input of buffer amplifier 46. The complete "Upper Rotor" includes signal line 45 and amplifier 46. In the actual circuitry it is not the entire magnitude of the input signal 13 that is fed to buffer amplifier 46, but only a portion of that magnitude, such as for example, about 15%. This undelayed signal is then combined in a subtractive relationship with the delayed upper band signal which has been frequency modulated by injection of the upper band vibrato or tremulant signal therein. The effect of combining the signals in this manner is to provide an identifiable "CHIRP" in the audio output of the musical instrument.

It is of course possible to reverse the connections of these two signals to the inputs of buffer amplifier 46, and as they will still be in a subtractive relationship to each other, the result is the same.

The same circuit is utilized in the processing of the lower band signal, where an undelayed portion of the lower band signal is passed along a signal line 47 around the frequency modulation unit 20 and applied to one of the inputs of buffer amplifier 48. Again, the two signals are combined in the buffer amplifier in a subtractive relationship.

The CHIRP as presently constituted is very effective in reproducing or simulating a well-known characteristic of electronic organs that utilize a pair of rotatably driven loudspeakers, commonly referred to as a Leslie system after the name of its original inventor.

FIG. 10 shows the passage of a 2000 Hertz sine-wave signal through the "Upper Rotor" circuit. In FIG. 10*a* the modulator is stopped; in FIG. 10*b* it oscillates at about one Hertz; and in FIG. 10*c* it oscillates at about six Hertz.

BAND RECOMBINATION AND RESEPARATION

As shown in FIG. 1, it is preferred to separate the original musical signal at about 800 Hertz into upper and lower signal bands for purpose of separately modulating those bands with vibrato signals having characteristics that differ significantly from each other. It is then preferred to recombine the bands so as to provide a composite signal which has been enriched by the frequency modulating circuits. It has also been pointed out that recombining the signals in this manner results in cross-modulation between the tone characteristics that were previously added into the musical tones in the two separate modulation circuits, and that this cross-modulation further enriches the harmonic structure of the final musical tones.

It will be appreciated by those skilled in the art of electronic circuitry as applied to musical instruments that recombining of modulated signals in this manner, if it has been done at all, has had little or no real success. The reason has been that the modulation techniques heretofore employed have injected considerable circuit noise along with the new harmonic musical structure, the circuit noise being particularly evident in the form of identifiable portions of the clock pulse signal employed for sampling the original musical signal. The novel sampling methods and circuits of the present invention, however, have greatly reduced this noise problem, to the extent that it can be said it has been substantially eliminated. Thus, the combination of the separately modulated signals can be accomplished very successfully.

After the signals have been recombined it is, however, greatly preferred in accordance with the present invention to again separate the signals into separate upper and lower bands. If only two speakers are being used, one for high frequency and one for bass, the separation frequency is preferred to be about 200 Hertz. However, if a more complex array of speakers are utilized, it may be desired to separate the signal into several frequency bands, with the selection of the bands being made to conform to the range, amplitude, and fidelity characteristics of the speakers.

Thus it will be evident that in accordance with the present invention the first separation of the musical signals into separate frequency bands has been accomplished according to one criteria, for optimizing the injection of new harmonic structures into the musical tones, while the second separation of the frequencies has been done according to a second and different criteria for the purpose of optimizing the performance of the loudspeakers.

EXTERNAL ORGAN SPEAKER (FIG. 11–14)

The present invention also provides a unique external speaker system for an electronic organ, which speaker system may incorporate the novel vibrato or tremulant circuit of the present invention, or instead may utilize only conventional circuitry.

FIG. 11 is a perspective view of an electronic organ 110 to which an external speaker system 111 is coupled by means of a cable 109. Speaker system 111 is in the form of an elevated structure or tower and is therefore referred to as a tower speaker system.

FIG. 12 is a schematic block diagram which illustrates in a broad conceptual manner the way in which the external speaker system of the present invention may be utilized in conjunction with an electronic organ. Thus an electronic organ 110 has an output 112 for non-tremulant voices, as well as an output 113 for voices such as the tibia to which the tremulant or vibrato signal is to be applied. Non-tremulant output 112 is fed directly to an amplifier 116. The tremulant output 113 is fed to a tremulant circuit 115 whose output in turn is fed to the amplifier 116. The output of amplifier 116 is fed to a set of fixed speakers 117. The concept illustrated in FIG. 12 is that, utilizing a single set of fixed speakers, which are powered from a single amplifier or single set of amplifiers, the electronic organ may nevertheless be provided with separate outputs for the musical sounds of voices that require vibrato or tremulant, as well as those which do not, and both these types of organ outputs may be accommodated with the single set of amplifiers and single set of fixed speakers.

FIG. 13 is an interior side elevation view of the tower speaker system 111. As seen from FIG. 13 in conjunction with FIG. 11 the speaker housing is of a rectangular or box-like configuration and may have a width of about 15 inches, a depth of about 15 inches from front to rear, and a height above the floor surface of about 40 inches. The complete housing includes a base section 120 adapted to rest upon a floor surface, a top cover or cap in the form of an inverted cup-shaped member 128, and has a front grill 121 on its flat front side and a rear grill 122 on its flat rear side.

Inside the tower speaker 111 there are contained two bass speakers 123 and 124, each having a diameter of the order of 10 inches. Bass speaker 123 is situated inside the front grill 121 and has its upper extremity located at about the mid-point of the vertical height of the tower. Bass speaker 124 is located inside the rear grill 122 and at the approximate center of the vertical height of the tower. A single output circuit 131 feeds both of the bass speakers 123, 124.

Also included in the tower are a treble speaker 125 and a treble speaker 126, each having a diameter of the order of about 5 inches. Treble speaker 125 is supported inside the upper extremity of the front grill 121, being slightly more than two-thirds the height of the tower above the floor surface. High frequency speaker 126 is mounted at the same elevation as speaker 125 but supported inside the upper portion of the rear grill 122. Rear grill 122 is easily distinguished by the fact that cable 109 enters the tower immediately below the lower extremity of the rear grill. Separate driving circuits 132, 133 are coupled to the speakers 125, 126, respectively. An internal floor 129 contained within the tower at the upper extremity of base 120 supports a plurality of circuit boxes 130. Cable 109 enters directly into one of the circuit boxes while the driving circuits 131, 132, 133 extend upward from one or more of these boxes.

The internal wiring of the tower speaker system of FIG. 13 is schematically illustrated in FIG. 14. A tremulant or vibrato channel number 1 and a non-tremulant channel number 2 are contained within the cable 109. Channel 1 is fed to the M.D.S. circuit while channel 2 is fed to a pre-amp circuit. The M.D.S. circuit preferably corresponds to the complete Upper Rotor circuit of FIG. 2. One output from the M.D.S. circuit is supplied to a high pass filter 141, hence to a high frequency power amplifier 145, and hence through driving circuit 132 to the treble speaker 125. A second output from the M.D.S. circuit is supplied to low pass filter 142, hence to bass power amplifier 146, and hence through driving circuit 131 to both of the bass speakers 123, 124. From the preamplifier circuit channel 2 is fed on one output to a high pass filter 143, and from there to a high frequency power amplifier 147 and hence through driving circuit 133 to the treble speaker 126. A second output of the preamplifier circuit for channel 2 is fed to a second input of the low pass filter 142, so that after amplification by the bass amplifier 146 this signal is also supplied to both of the bass speakers.

Thus in the illustrated tower speaker system the vibrato or tremulant circuit has its frequencies separated at about 200 Hertz, in accordance with earlier descriptions, and powers both of the bass speakers 123, 124 as well as the front treble speaker 125. The signal in the non-tremulant input is likewise separated at about 200 Hertz and, after amplification, powers both of the bass speakers as well as the rear treble speaker 126.

The speaker system shown in FIGS. 11–14 operates, to some extent, as a stereo speaker system. The bass speakers handle only the frequencies below about 200 Hertz, which because of their lower frequency and longer wave length involve less sensitivity on the part of the hearer as to the location and direction from which the sound emanates. For the treble speakers however, the frequencies above 200 Hertz are detected with greater sensitivity by the human ear, and the differences in location and direction between the front treble speaker 125 and the rear treble speaker 126 are easily detectable. Thus a kind of stereo effect is achieved. The preferred mode of usage is to place the rear face of the speaker tower near the wall of a room in which the speaker system is being used, but spaced a distance of two or three feet from that wall. The reflection of sound from the wall then cooperates with the speaker system itself to provide a stereo effect.

Although as shown in FIGS. 12 and 14 one of the speaker channels contains the novel vibrato or M.D.S. circuit of the present invention, the speaker system may also be utilized without that circuit. Channel 1 is then a straight channel and includes a conventional preamplifier. The same stereo effect is achieved but there is no vibrato or tremulant signal generated within the speaker system itself.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A method of frequency-modulating a continuously varying electrical signal representing an original musical sound so as to produce a modulated output signal that will provide a harmonically enriched version of the musical sound, comprising the steps of:

generating a clock-pulse signal at a repetition rate of at least about 200,000 per second;

frequency-modulating the clock-pulse signal according to an essentially sine-wave signal having a frequency of less than fifteen Hertz;

combining the modulated clock-pulse signal with the continuously varying electrical signal to produce a series of pulses whose amplitude envelope corresponds to that of the continuously varying electrical signal;

supplying the series of pulses to the input end of a multi-stage shift register;

applying the modulated clock-pulse signal to all stages of the shift register so as to advance the series of pulses therealong and thereby produce a series of delayed pulses at its output end;

at the output end of the shift register, gating a central portion only of each of the delayed pulses so as to exclude both its leading and trailing edges;

utilizing the gated pulses to create a frequency-modulated version of the original amplitude envelope; and then producing the output signal in response to said frequency-modulated version of the original amplitude envelope.

2. The method of claim 1 which includes the additional step of sensing the original amplitude envelope of the continuously varying electrical signal; and wherein the output signal is produced in response to both the original amplitude envelope of the continuously varying electrical signal and said frequency-modulated version thereof.

3. The method of synthesizing musical sound in accordance with claim 1 wherein a diminished but undelayed signal is produced which corresponds to a portion of the original electrical signal, and wherein said frequency-modulated version of the original amplitude envelope is subtracted from said diminished but undelayed signal to produce the output signal.

4. The method of claim 1 wherein the original signal is continuously sensed to produce a weakened but relatively undelayed signal which is representative thereof; and wherein the output signal is produced in response to both said weakened but undelayed signal and said frequency-modulated version of the original amplitude envelope.

5. The method of modifying a continuously varying original electrical signal which represents an original musical sound so as to acoustically produce a harmonically enriched version of the musical sound, comprising the steps of:

separating the original signal into upper frequency and lower frequency signal bands;

converting each of said signal bands into a series of evenly spaced pulses whose amplitudes correspond to that of the signal from which they were derived;

generating two substantially sine-wave modulation signals each having a frequency below about 15 Hertz, the frequencies of said two modulation signals being unrelated to each other and being unsynchronized;

delaying each of said pulse series and frequency modulating each of them with a corresponding one of said modulation signals so as to alter the spacing between pulses in response to the corresponding modulation signal;

gating each altered and delayed pulse series so as to select a central portion of each pulse while rejecting both its leading and trailing edges;

creating a new continuous signal in response to the envelope of said delayed, altered, and gated pulses of each series, thereby providing a pair of frequency-modulated electrical signals which together represent a modified version of the original signal; and then applying said modified signal to a fixed speaker system so as to produce for the listener an enriched musical sound which includes both of said modulation frequencies as well as a third frequency corresponding to the difference between said modulation frequencies.

6. In the art of modifying musical sound represented by a continuously varying electrical signal to inject a vibrato or tremulant therein, by first converting the signal to a series of evenly spaced pulses whose amplitudes correspond to that of the original signal, then delaying the pulses and altering the spacing between them in response to a modulation signal having a frequency below about 15 Hertz, and thereafter creating from the altered pulse series a new continuous frequency-modulated signal that is substantially delayed relative to the original signal, the improvement comprising:

gating the altered and delayed pulses so as to select a central portion of each pulse while rejecting both its leading and trailing edges to thereby create a delayed and gated pulse series;

continuously sensing the original signal to produce a weakened but relatively undelayed signal which is representative thereof; and then creating the new continuous signal in response to a combination of said delayed and gated pulse series and said weakened signal.

7. An external speaker system for an electronic organ, comprising:

a cabinet of generally rectangular configuration having front and rear faces opposed at 180° to each other and adapted for transmission of sound therethrough;

front and rear bass speakers disposed within said cabinet in proximity to respective ones of said sound transmitting faces;

front and rear treble speakers disposed within said cabinet in proximity to respective ones of said sound transmitting faces;

a bass amplifier coupled to both of said bass speakers for transmitting a driving signal thereto;

separate front and rear high frequency amplifiers coupled to respective ones of said treble speakers for supplying driving signals thereto;

an input channel for non-tremulant organ tones;

frequency responsive means coupling said non-tremulant input channel to said bass amplifier and to said rear high-frequency amplifier and operative for passing frequencies below about 200 Hertz to said bass amplifier and frequencies above about 200 Hertz to said rear high-frequency amplifier;

an input channel for organ tones to which a vibrato or tremulant sound is to be added;

an electronic tremulant circuit coupled to said tremulant input channel and adapted for adding a vibrato or tremulant sound to organ tones received therefrom; and frequency responsive means coupling said electronic tremulant circuit to said bass amplifier and said front treble amplifier and operative for transmitting frequencies below about 200 Hertz to said bass amplifier and frequencies above about 200 Hertz to said front treble amplifier.

8. An electronic tremulant circuit for adding vibrato or tremulant to electronically generated musical tones, comprising, in combination:

a preliminary crossover network adapted to receive an input signal representing musical tones, and to separate same into upper and lower band frequencies which are respectively above and below a frequency of about 800 Hertz;

an upper band frequency modulator coupled to said preliminary crossover means for receiving said upper band frequencies;

a lower band frequency modulator coupled to said preliminary crossover network for receiving said lower band frequencies;

each of said frequency modulators having associated modulating means, said two modulating means being adapted to modulate the received signals at different frequencies and amplitudes;

a summing circuit coupled to the outputs of both of said frequency modulators for summing the modulated upper and lower band frequencies;

final crossover means coupled to said summing circuit and responsive to the composite modulated signal received therefrom for separating the same into high and low frequencies that are respectively above and below a frequency of about 200 Hertz;

a high frequency amplifier coupled to the output of said final crossover means for receiving the high frequency signals therefrom;

a fixed high frequency speaker coupled to said high frequency amplifier to be driven thereby;

a low frequency amplifier coupled to the output of said final crossover means for receiving said low frequencies therefrom; and a fixed bass speaker coupled to said low frequency amplifier to be driven thereby.

* * * * *